United States Patent [19]

Smith

[11] Patent Number: 4,570,928

[45] Date of Patent: Feb. 18, 1986

[54] PUSH-PULL SWING

[76] Inventor: Jack L. Smith, 10518 Ocean Dr., Baytown, Tex. 77520

[21] Appl. No.: 460,741

[22] Filed: Jan. 24, 1983

[51] Int. Cl.[3] ..... A63G 9/00

[52] U.S. Cl. ..... 272/87

[58] Field of Search ..... 272/87, 85, 86, 87, 272/88, 89, 90, 91, 92; D21/246; 297/452, 276, 277, 278, 279, 280

[56] References Cited

U.S. PATENT DOCUMENTS

| | | | |
|---|---|---|---|
| 217,465 | 7/1879 | Lashorne | 272/90 |
| 334,965 | 1/1886 | McCorkle | 272/92 |
| 1,412,723 | 4/1922 | Toal | 272/87 |
| 1,434,434 | 11/1922 | Eycleshymer | 272/89 |
| 1,888,587 | 11/1932 | De Penning | 272/87 |
| 2,256,955 | 9/1941 | Stevens | 272/87 |
| 2,358,098 | 9/1944 | Pippin | 272/87 |
| 2,900,010 | 8/1959 | Oliver | 272/87 |

FOREIGN PATENT DOCUMENTS

| | | | |
|---|---|---|---|
| 103036 | 1/1938 | Australia | 272/87 |
| 546501 | 9/1957 | Canada | 272/87 |
| 629091 | 10/1961 | Canada | 272/87 |

*Primary Examiner*—Robert A. Hafer
*Assistant Examiner*—Arnold W. Kramer
*Attorney, Agent, or Firm*—Mosely, Neal J.

[57] ABSTRACT

This swing, through a backward and forward motion by the user, serves to provide amusement and excellent exercise for children and adults. Primarily, it consists of a vertical frame, including a handle bar and a foot rest bar for its operation. It also includes a pair of joined and hinged horizontal bars with a pair of seats, and it is supported by ropes. It further includes fasteners for its adjustment in length and height.

1 Claim, 4 Drawing Figures

PUSH-PULL SWING

This invention relates to exercise and amusement devices, and more particularly, to a push-pull swing.

The principal object of this invention is to provide a push-pull swing, which will employ the use of a person's hands and feet to produce a backward and forward motion.

Another object of this invention is to provide a push-pull swing, which will give its users excellent stomach exercise, due to the pushing and pulling of the hands and feet, and the bending motion performed when the swing moves back and forth.

Another object of this invention is to provide a push-pull swing, which will be unique, in that the user does not have to be pushed, when using it, and its structure is ideal for use by a small child and an adult, simultaneously, because the size or weight of the users has no apparent effect on the swinging motion of the swing.

A further object of this invention is to provide a push-pull swing, which will be enjoyed by both children and adults, and it will also be safe in operation, when used by either one or two persons.

A still further object of this invention is to provide a push-pull swing, which will be adjustable, so as to fit persons of various sizes, and it is further adjustable, so as to regulate the amount of bending motion and effort required to operate the swing for the desired exercise.

An even further object of this invention is to provide a push-pull swing, which may be easily mounted to ceiling joists, by the employment of hooks and eyes, because it doesn't require expensive steelwork, and the swing may be easily removed and stored, when desired. Basically, this swing is designed for indoor use. However, it may also be used outdoors with proper mounting framework.

Other objects are to provide a push-pull swing, which is simple in design, inexpensive to manufacture, rugged in construction, easy to use, and efficient in operation.

These, and other objects, will be readily evident, upon a study of the following specification, and the accompanying drawings, wherein.

Figure 1:
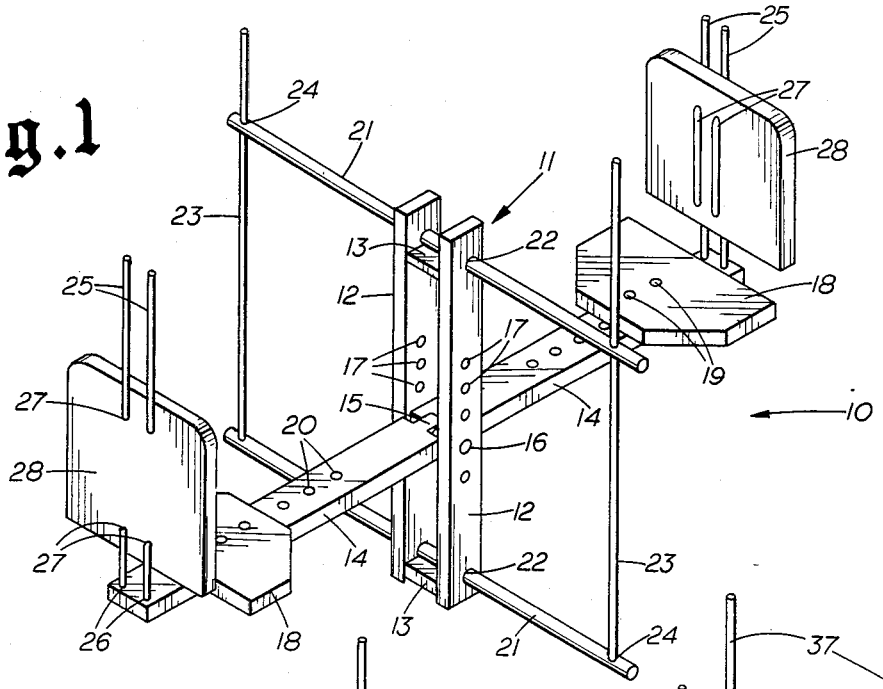
FIG. 1 is a perspective view of the present invention.

According to this invention, a swing 10 is shown to consist of a frame 11, which includes a pair of spaced-apart bars 12. Bars 12 are reinforced by a pair of cross-members 13, which are fixedly secured therebetween by suitable fasteners, not shown. A pair of horizontal bars 14 are tongue and grooved at 15, and receive a pin 16, which is also received and suitably fastened in any pair of the plurality of oppositely opposed openings 17 through bars 12. The placement of pin 16 in the openings 17 depends upon where the user wishes the elevation of the horizontal bars 14 to be, and a seat rest 18 is secured to bars 14 by a pair of suitable fasteners 19, which are secured in any of the openings 20 of bars 14 desired. The placement of the seat rests 18 is adjustable by the placement of the fasteners 19, so as to adapt the swing 10 to various sized persons, and the desired bending by the user is also effected by the placement of the seat rests 18.

It shall be noted, that the pin 16 is removable from bars 14 and frame 11, so as to enable one of the seat rests 18 to be used only if desired, and pin 16 is also removable, to elevate or lower bars 14, for exercising the user's legs and stomach, and wherever pin 16 is located in elevating and lowering bars 14, various combinations of body muscles will be exercised.

A pair of horizontal and spaced-apart dowels 21 are fixedly secured in openings 22, through bars 12 of frame 11, and extend equally from each side thereof, for receiving the pair of ropes 23 therein. The ropes 23 extend from the openings 24 through the ends of dowels 21, and are suitably knotted at their bottom ends. The upper ends are suitably secured to ceiling joists or other framework in a suitable manner, not shown. A pair of back rest ropes 25 are also secured in the same above-mentioned manner, at the top ends, as ropes 23, and the bottom ends thereof are received in openings 26 through the ends of bars 14, where they are knotted. Ropes 25 are further received, frictionally, through the plurality of openings 27, which are oblique in direction through the pair of back rests 28, and the back rests 28 are elevatable by the users, so as to provide for maximum comfort.

It shall also be noted, that the tongue and groove 15 combination of connecting bars 14 also serves to eliminate any need to change the length of the ropes 25, when pin 16 changes are made, and the upper dowel 21 serves as a handle bar for the placement of the user's hands, while the lower dowel 21 serves as a foot rest for the user's feet.

In use, swing 10 is first fastened, by its ropes 23 and 25, to ceiling joists or other framework, by hooks and eyes. When the user or users are seated on seat rests 18, they grasp the upper dowel 21 with the hands, and the feet are placed on the lower dowel 21. After the above-mentioned placement of hands and feet, the user or users then effect an alternating push-pull motion with their hands and feet, which will impart a swinging motion to swing 10. If the back rest 28 is not in a comfortable position, the user unseats himself, and lowers or elevates the back rest 28 with his hands, because back rests 28 are frictionally received on ropes 25. For forward and rearward movement of seat rests 18, the user removes the fasteners 19, and places them in other openings 20 of the bars 14. When elevation or lowering of bars 14 is desired, the user removes pins 16 from openings 17 and the tongue and groove 15 combination, and replaces pin 16 in other lower or upper openings 17 and the tongue and groove combination 15.

Figure 2:
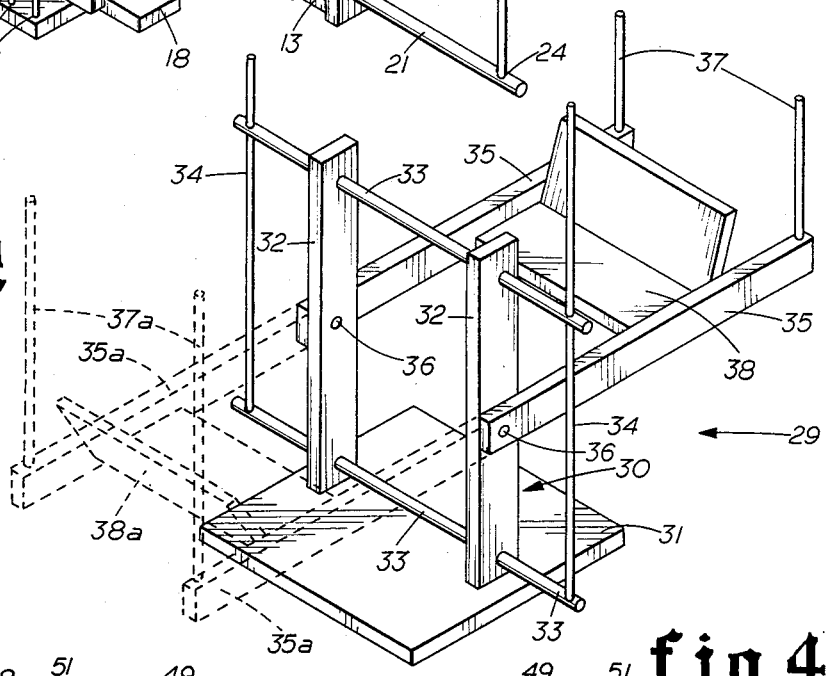
FIG. 2 is a perspective view of a modified form of FIG. 1, which illustrates a second seat in phantom lines.

Referring now to FIG. 2 of the drawing, a modified form of swing 29 is shown to consist of a frame 30, having a foot rest plate 31. A pair of spaced-apart and vertical bars 32 are fixedly secured, at one end, to the top of plate 31, by suitable fasteners (not shown), and an upper and lower dowel 33 is fixedly secured in bars 32, in the same manner as was described of swing 10. Dowels 33 also receive ropes 34 in the same manner described of swing 10, and a pair of parallel horizontal bars 35 are fixedly secured, at one end, to bars 32, by pins 36. A pair of ropes 37 are secured to the opposite ends of bars 35 in the same manner as ropes 34 are secured to dowels 33, and ropes 37 and 34 are supported from joists or other framework by hooks and eyes (not shown), so as to enable swing 29 to depend downward. A seat 38 is fixedly secured, at its side edges, between bars 35, by suitable fastening means, (not shown), and a similar seat **38*a*, with ropes 37*a*, may also be secured to the bars 32 by a pair of secondary bars 35***a* and the pins 36.

In use, swing 29 functions in the same manner as was heretofore described of swing 10, with the exception, that the user will be seated between the bars 35 or 35*a*, and the feet and hands will be placed on the center portions of the dowels 33, which serve as handle grips and foot rests, respectively. The plate 31 also enables the user or users to rest the feet thereon, if desired.

It shall further be noted, that modified swing 29 is primarily designed to be a family outdoor or playground swing.

Figure 3:
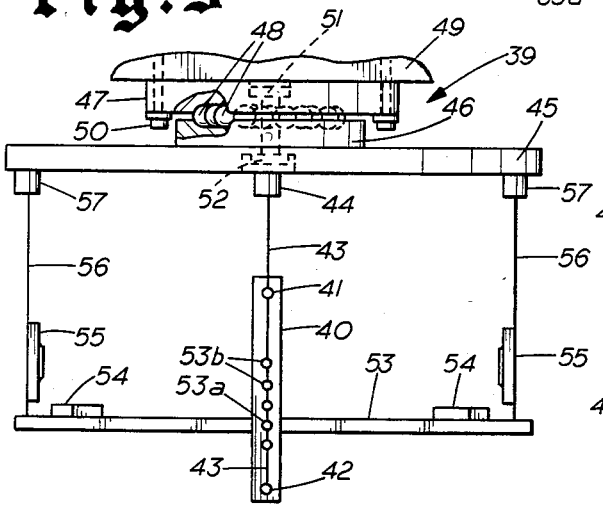
FIG. 3 is a front elevational view of another modified form of the invention.
Figure 4:
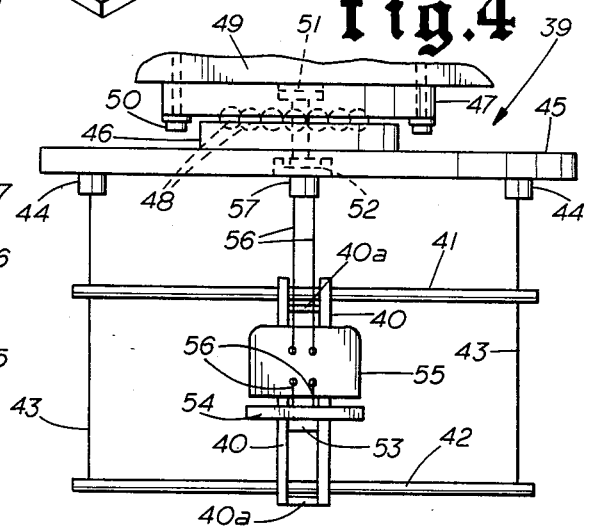
FIG. 4 is a right side view of FIG. 3.

Referring now to FIGS. 3 and 4, another modified swing 39 of a unique carrousel construction, is shown to include a pair of vertical and parallel bars 40, which have an upper dowel 41 and a lower dowel 42 fixedly secured therein, as was heretofore described of the dowels 21 and 33 of their respective bars 12 and 32. Bars 40 also include upper and lower cross-bar members 40*a*, which are fixedly secured between bars 40 in a suitable manner. The upper dowel 41, which serves as a handle bar, and the lower dowel 42, which serves as a foot rest, are fixedly secured in openings of bars 40, and their outer ends receive a rope 43, which is knotted at the bottom of dowel 42. The upper ends of ropes 43 are fixedly secured within hubs 44, that are fixedly secured to the bottom of disc 45 in a suitable manner. A ball bearing race 46 is fixedly secured, in a suitable manner, to the top of disc 45, and the opposite bearing race 47, in cooperation with race 46, retains a plurality of ball bearings 48. Bearing race 47 is secured to ceiling joists 49 by a plurality of bolt or screw fasteners 50, and a bolt fastener 51, in the center of bearing races 46 and 47, and the disc 45 receives a nut fastener 52, so as to secure bearing and disc 45 assembly together, which will enable rotation of swing 39, simultaneously with its swinging motion, when in use.

A horizontal bar 53 is pinned to bars 40 by a pin 53*a*, which may be received in any of a pair of openings 53*b* that align with each other in bars 40, so as to lower or elevate bar 53 to any desired position, and a seat 54 is fixedly secured to the top of bar 53 near each end, for seating two people. A back rest 55 is frictionally received on a pair of ropes 56, in the same manner as was heretofore described of the back rests 28 of swing 10, and the bottom of ropes 56 are suitably secured to the end portions of bar 53. The upper ends of ropes 56 are suitably secured within hubs 57, which are fixedly secured to the bottom of disc 45 in a suitable manner.

In use, swing 39 operates in the same manner heretofore described of swing 10, with the exception, that the bars 40, the bar 53, the dowels 41 and 42, the seats 54, and the back rests 55 are depending from a disc 45 which is mounted to bearing races 46 and 47, which permit a carrousel rotation motion, simultaneously with the back and forth swinging motion, when the users are seated upon the seats 54.

It shall further be recognized, that modified swing 39 may be further modified in construction, so as to include a single seat, which will be mounted to a single frame, secured fixedly to a pair of vertical bars that are secured fixedly to a bar, depending from a bearing mounted disc by cord means.

It shall also be further recognized while not shown on drawing, that horizontal bars 14 on swing 10 are also adjustable in elevation by the use of link chain and hooks installed in series with ropes 25, which gives still further adjustment to said swing for exercise.

While various changes may be made in the detail construction, it is understood that such changes will be within the spirit and scope of the present invention, as is defined by the appended claims.

What I now claim is:

1. A push-pull swing comprising in combination a frame having at least one horizontally extending bar having a pair of vertically extending apertures at one end thereof, a pair of vertically extending substantially parallel ropes secured one in each of said apertures and adapted to be secured to an elevated support, a pair of parallel spaced-apart vertically extending bars of substantially equal length pivotally secured at their midsection on opposite sides of said horizontally extending bar and spaced a substantial distance from said one end, said vertically extending bars each having a plurality of vertically spaced horizontally extending and axially aligned openings therethrough, said pair of vertically extending bars having upper and lower reinforcing cross members, of substantially greater length than the spacing therebetween, secured in the uppermost and lowermost openings thereof with outer end portions extending outward therefrom and having vertically extending apertures therein, said connection of said horizontal bar to said vertical bars comprising a pin passing therethrough and through selected openings of said vertical bars intermediate said uppermost and lowermost openings and providing a releasable and pivotal connection at a vertically adjustable position, said horizontally extending bar having a plurality of longitudinally spaced vertical apertures therein, a seat member adjustably secured to said horizontal bar in said last named apertures, a back rest member having holes through which said pair of ropes are threaded whereby said backrest member may be vertically adjusted and retained in an adjusted position, and another pair of vertically extending ropes secured one in each of said apertures in the ends of said cross members and adapted to be secured to an elevated support, whereby said swing is supported by said pairs of spaced vertical ropes facilitating horizontal movement thereof by the occupant pulling on said upper cross member end portions and pushing with the feet on said lower cross member.

* * * * *